US006020955A

United States Patent [19]

Messina

[11] Patent Number: 6,020,955

[45] Date of Patent: Feb. 1, 2000

[54] SYSTEM FOR PSEUDO ON-GIMBAL, AUTOMATIC LINE-OF-SIGHT ALIGNMENT AND STABILIZATION OF OFF-GIMBAL ELECTRO-OPTICAL PASSIVE AND ACTIVE SENSORS

[75] Inventor: Peter V. Messina, Santa Monica, Calif.

[73] Assignee: Raytheon Company, Lexington, Mass.

[21] Appl. No.: 09/152,952

[22] Filed: Sep. 14, 1998

[51] Int. Cl.[7] ..... G01B 11/26

[52] U.S. Cl. ..... 356/138; 356/138; 356/341; 356/253; 356/145

[58] Field of Search ..... 356/138, 341, 356/18, 253, 145

[56] References Cited

U.S. PATENT DOCUMENTS 3,995,944 12/1976 Queeney ..... 350/285

4,576,449 3/1986 Ruger ..... 359/555

*Primary Examiner*—Frank G. Font
*Assistant Examiner*—Reginald A. Ratliff
*Attorney, Agent, or Firm*—Colin M. Raufer; Leonard A. Alkov; Glenn H. Lenzen, Jr.

[57] ABSTRACT

A system that automatically aligns and stabilizes off-gimbal electro-optical passive and active sensors of an electro-optical system. The alignment and stabilization system dynamically boresights and aligns one or more sensor input beams and an output beam of a laser using automatic closed loop feedback, a reference detector and stabilization mirror disposed on a gimbal, off-gimbal optical-reference sources and two alignment mirrors. Aligning the one or more sensors and laser to the on-gimbal reference detector is equivalent to having the sensors and laser mounted on the stabilized gimbal with the stabilization mirror providing a common optical path for enhanced stabilization of both the sensor and laser lines of sight.

9 Claims, 4 Drawing Sheets

LASER REFERENCE SOURCE
LASER
FROM 60
IR RECEIVER
IR RECEIVER REFERENCE SOURCE
CCD RECEIVER
CCD REFERENCE SOURCE
PHOTO-DETECTOR
IMU
PROCESSOR
TO 60
FROM 60
IR
L

SYSTEM FOR PSEUDO ON-GIMBAL, AUTOMATIC LINE-OF-SIGHT ALIGNMENT AND STABILIZATION OF OFF-GIMBAL ELECTRO-OPTICAL PASSIVE AND ACTIVE SENSORS

BACKGROUND

The present invention relates generally to electro-optical systems, and more particularly, to a system that provides line-of-sight (LOS) alignment and stabilization of off-gimbal electro-optical passive and active sensors.

The assignee of the present invention manufactures electro-optical systems, such as forward looking electro-optical systems, for example, that include electro-optical passive and active sensors. A typical electro-optical system includes subsystems that are located on a gimbal while other subsystems that are located off of the gimbal.

In certain previously developed electro-optical systems, sensor and laser subsystems are located off-gimbal, and there was no auto-alignment of the sensor and laser lines of sight. Furthermore, there was no compensation for motion due to vibration, thermal or g force angular deformation in and between the optical paths for the sensor and laser subsystems. Large errors between the sensor line of sight and the laser line of sight were present that limited effective laser designation ranges, weapon delivery accuracy, and target geo-location capability, all of which require precise laser and sensor line-of-sight alignment and stabilization.

The resolution and stabilization requirements for third generation tactical airborne infrared (IR) systems are in the same order of magnitude as required by space and strategic systems but with platform dynamics and aerodynamic disturbances orders of magnitude higher, even above those encountered by tactical surface systems. The environments of third generation airborne system approach both extremes and can change rapidly during a single mission. However, conformance to the physical dimensions of existing fielded system is still the driving constraint.

Ideally, a high resolution imaging and laser designation system in a highly dynamic disturbance environment would have, at least, a four gimbal set, with two outer coarse gimbals attenuating most of the platform and aerodynamic loads and the two inner most gimbals providing the fine stabilization required, with the inertial measurement unit (IMU) and IR and visible imaging sensors and laser located on the inner most inertially stabilized gimbal.

In order to reduce gimbal size, weight, and cost, the assignee of the present invention has developed a pseudo inner gimbal set for use on HNVS, AESOP, V-22 tactical airborne and Tier 11 Plus airborne surveillance systems using miniature two-axis mirrors, mounted on the inner gimbal together with both the IMU and IR sensor, in a residual inertial position error feedforward scheme, to replace the two innermost fine gimbals, while maintaining equivalent performance. With increasing aperture size and constrained by maintaining the size of existing fielded systems, some tactical airborne IR systems are forced to locate the IR and visible sensors and laser off of the gimbals using an optical relay path, such as in the Advanced Targeting FLIR (ATFLIR) system.

In order to re-establish an ideal configuration, a pseudo on-gimbal IR sensor and laser configuration must be implemented, such as by using the principles of the present invention, with an active auto-alignment scheme with the use of miniature two-axes mirror technology. An active auto-alignment mirror configuration is in effect equivalent to having the IR sensors and auxiliary components, such as the laser, mounted on the stabilized gimbal.

An Airborne Electro-Optical Special Operations Payload (AESOP) system developed by the assignee of the present invention uses a hot optical reference source mechanically aligned to a laser. During calibration, the reference source is optically relayed through the laser window into the IR sensor window and steered to the center of the IR field of view with a two-axis steering mirror in the laser optical path. This mirror is also used in the operational mode to stabilize the laser beam. An additional mirror in the IR optical path is used to stabilize the IR beam. Since the alignment is performed initially during calibration and not continuously, during laser firing in the operational mode, the laser optical bench thermally drifts from the IR sensor optical bench and the two lines of sight are no longer coincident as when initially aligned. Further line-of-sight misalignments can be incurred by structural vibrational motion in and between the optical paths.

It would therefore be desirable to have a system for providing line-of-sight alignment and stabilization of off-gimbal electro-optical passive and active sensors. Accordingly, it is an objective of the present invention to provide for a system that provides for line-of-sight alignment and stabilization of off-gimbal electro-optical passive and active sensors.

SUMMARY OF THE INVENTION

To accomplish the above and other objectives, the present invention provides for a system that automatically aligns and stabilizes off-gimbal electro-optical passive and active sensors of an electro-optical system. The present invention comprises a pseudo on-gimbal automatic line-of-sight alignment and stabilization system for use with the off-gimbal electro-optical passive and active sensors. The alignment and stabilization system dynamically boresights and aligns one or more sensor input beams and a laser output beam using automatic closed loop feedback, a single on-gimbal reference detector (photodetector) and stabilization mirror, two off-gimbal optical-reference sources and two alignment mirrors. Aligning the one or more sensors and laser to the on-gimbal reference photodetector is equivalent to having the sensors and laser mounted on the stabilized gimbal with the stabilization mirror providing a common optical path for enhanced stabilization of both the sensor and laser lines of sight.

More specifically, an exemplary embodiment of the present invention comprises optical apparatus for use in auto-aligning line-of-sight optical paths of at least one sensor and a laser. The optical apparatus comprises at least one reference source for outputting at least one reference beam that is optically aligned with the line-of-sight of the at least one sensor, and a laser reference source for outputting a laser reference beam that is optically aligned with the line-of-sight of the laser.

A laser alignment mirror is used to adjust the alignment of the line of sight of the laser beam. A sensor alignment mirror is used to adjust the alignment of the at least one sensor. Combining optics is used to couple the plurality of reference beams along a common optical path. A gimbal apparatus is provided that houses the photodetector and which detects the plurality of reference beams, and a fine stabilization mirror for adjusting the line of sight of the optical paths of the at least one sensor and the laser. A processor is coupled to the photodetector, the laser alignment mirror, the sensor alignment mirror, and the fine stabilization mirror for processing signals detected by the photodetector and outputting control signals to the respective mirrors and combining optics to align the line-of-sight optical paths of the sensor and the laser.

The present invention implements a pseudo on-gimbal sensor and laser automatic boresighting, alignment, and dynamic maintenance system that augments functions of the on-gimbal stabilization mirror in the following ways. The system automatically boresights and aligns the sensor input beam coincident with the center of the on-gimbal photodetector, which is mechanically aligned to the system line of sight, by correcting for sensor optical train component misalignment. The system dynamically maintains the sensor boresight by automatically correcting the sensor line-of-sight angle for (a) sensor optical bench deformation due to thermal and platform g-forces, (b) nutation due to derotation mechanism wedge angle deviation errors, rotation axis eccentricity and misalignments, (c) field of view switching mechanism misalignment, (d) nutation due to gimbal non-orthocronality and tilt errors, and (e) induced angle errors caused by motion of focus mechanisms.

The system automatically boresights and aligns the laser output beam so that it is coincident with the center of the on-gimbal photodetector by correcting for laser optical train component misalignment and laser bench misalignment relative to the sensor optical bench. The system also dynamically maintains the laser boresight by automatically correcting the laser line-of-sight angle for (a) laser optical bench deformations due to thermal and platform g forces, and (b) relative angular motion between laser bench and isolated sensor optical bench due to linear and angular vibration and g forces, with the optical bench center of gravity offset from the isolator focus point.

The on-gimbal stabilization mirror compensates for the lower bandwidth inertial rate line-of-sight stabilization loops by feeding forward the residual rate loop line-of-sight inertial position error to drive the stabilization mirror to simultaneously enhance the stabilization of both the laser and sensor lines of sight.

The present invention may be used with any off-gimbal multi-sensor system requiring a coincident and stabilized line of sight, such as aircraft and helicopter targeting systems, and the like.

BRIEF DESCRIPTION OF THE DRAWINGS

The various features and advantages of the present invention may be more readily understood with reference to the following detailed description taken in conjunction with the accompanying drawings, wherein like reference numerals designate like structural elements, and in which.

DETAILED DESCRIPTION

Figure 1:
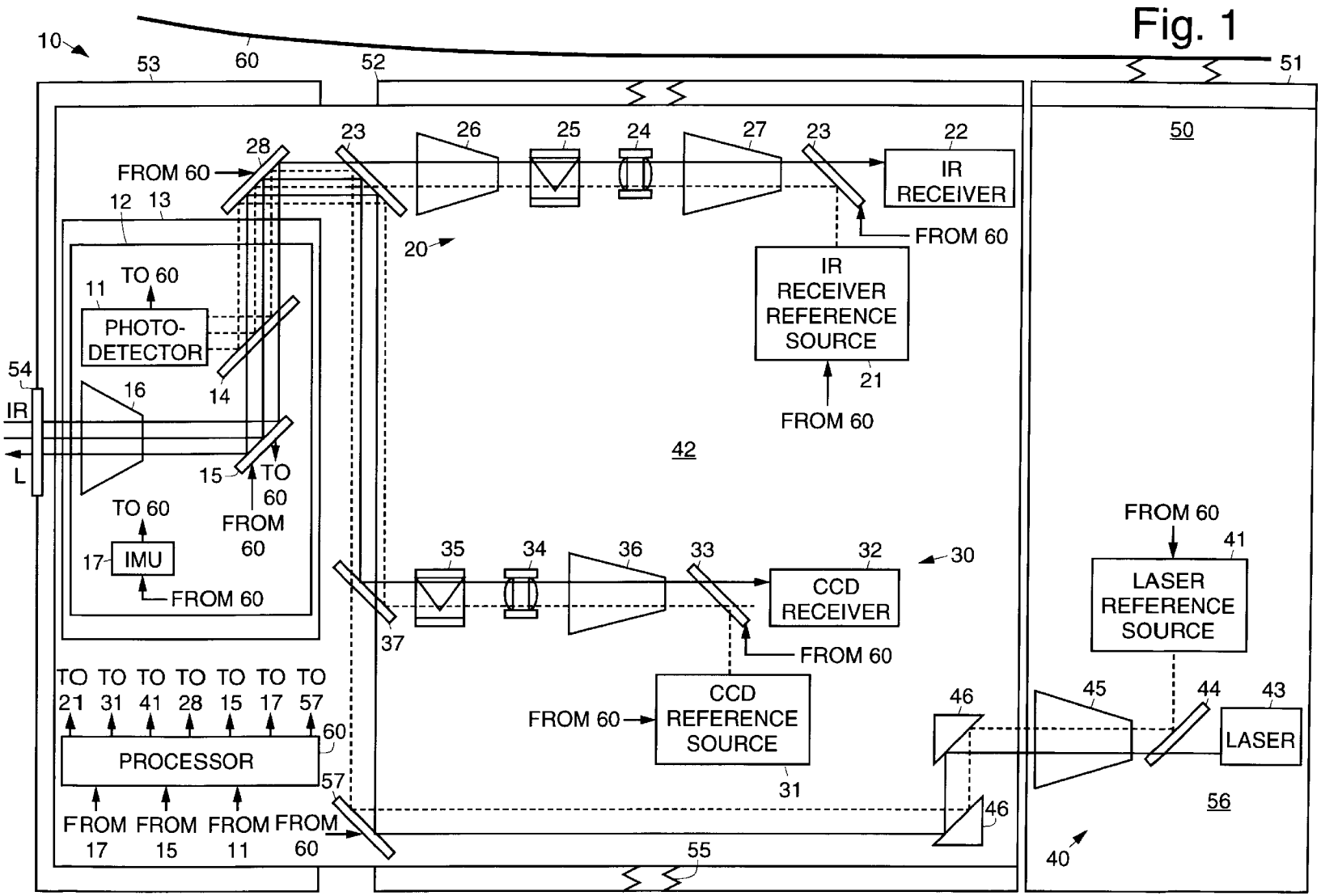
FIG. 1 illustrates an exemplary system in accordance with the principles of the present invention for providing line-of-sight alignment and stabilization of off-gimbal electro-optical passive and active sensors.

Referring to the drawing figures, FIG. 1 illustrates an exemplary system 10 in accordance with the principles of the present invention for providing line-of-sight alignment and stabilization of off-gimbal electro-optical passive and active sensors. The system 10 comprises a pseudo on-gimbal sensor 11 comprising a photodetector 11 or other light detector 11, an IR sensor 20, visible CCD sensor 30 and laser auto-alignment subsystem 40, and three time-multiplexed modulated reference sources 21, 31, 41 as is illustrated in FIG. 1. The reference sources 21, 31, 41 are time-multiplexed and pulse amplitude modulated to provide a simple multiplexing scheme without the need for extensive demodulation circuitry. The high frequency (10 KHz) time modulated pulses are simply synchronously sampled at the peak output response of the photodetector 11 by the processor, enabling closure of high bandwidth auto-alignment servo loops. The exemplary system 10 is implemented as an improvement to an Advanced Targeting FLIR pod 50 having on-gimbal mirror fine stabilization.

The pod 50 is shown attached to an airborne platform 70 by a pod aft structure 51 that is coupled to a laser optical bench 56. An outer roll gimbal 52 carrying a wind screen 53 with the window 54 that is gimbaled with bearings (not shown) in pitch, and rolls on bearings (not shown) relative to the pod aft structure 51. The roll gimbal 52 also carries along in roll an IR/CCD optical bench 42 that is attached at its center of gravity using an elastic isolator 55 that attenuates both vibration of the platform 70 and aerodynamic load disturbances to the IR/CCD optical bench 42 to provide for stabilization.

The IR/CCD optical bench houses an IR sensor receiver 22, the time multiplexed modulated infrared (IR) reference source 21 that is mechanically aligned to the center of the field of view of the IR sensor receiver 22, a multispectral beam combiner 27 that combines beams of the coaligned IR sensor receiver 22 and the IR reference source 21. In the IR optical path is an IR imager 29 (or IR imaging optics 29), a focus mechanism 24, a reflective derotation mechanism 25 that derotates the IR beam to keep the IR image erect, and a relay beam expander 26 that expands the beams associated with the coaligned IR sensor receiver 22 and IR reference alignment source 21.

The IR/CCD optical bench 42 also houses a visible CCD sensor receiver 32, the time multiplexed modulated CCD optical reference source 31 that is mechanically aligned to the center of the field of view of the CCD sensor receiver 32, a beam combiner 33 that combines the coaligned beams associated with the CCD sensor receiver 32 and the CCD reference source 31. In the optical path is a visible imager 36 (or visible imaging optics 36), a focus mechanism 34 and a refractive derotation mechanism 35 that derotates the visible channel beam to keep the visible image erect.

The laser optical bench 56 in the exemplary system 10 is not isolated and does not rotate with the roll gimbal 52. The laser optical bench 56 houses a laser 43, the time multiplexed modulated laser reference source 41 that is mechanically aligned to the output beam of the laser 43, a beam combiner 44 that combines the beams from the coaligned laser and laser reference source 41, and a beam expander 45 that expands the beams from the coaligned laser 43 and laser reference source 41. A pair of reflectors 46 are optionally used to couple the beams from the coaligned laser 43 and laser reference source 41 to a two-axis laser alignment mirror 57 on the IR/CCD optical bench 42. The reflectors 46 may not be required for other system configurations.

The two-axis laser alignment mirror 57 steers beams from the laser 43 and laser reference source 41 into alignment with the IR beam and the beam from the IR reference source 21. The CCD/laser beam combiner 37 combines the coaligned visible beam and beam from the CCD reference source 41 with the coaligned beams from the laser 43 and the laser reference source 41. The multispectral beam combiner 27 combines these four beams with the IR beam and the beam from the IR reference source 21, and all six beams are steered together onto an inner gimbal 12 using a two-axis IR/CCD alignment mirror 28.

The optical bench 42 houses an outer pitch gimbal 13 on bearings (not shown) which in turn mounts the inner yaw gimbal 12 on bearings (not shown). The inner gimbal 12 houses a multi-spectral beamsplitter 14 which transmits the IR, visible and laser beams and reflects beams from the modulated reference sources 21, 31, 41 into the photodetector 11 to close nulling auto-alignment loops. The photodetector 11 is mechanically aligned to the line of sight of a telescope beam expander 16. A two axis fine stabilization mirror 15 is used to stabilize the IR, visible and laser beams prior to the telescope beam expander 16. A three-axis fiber optic gyro, low noise, high bandwidth, inertial measurement unit (IMU) 17 is used to close the line-of-sight inertial rate stabilization loops, which generate fine stabilization mirror position commands relative to the line-of-sight of the inner gimbal 12. The wind screen 53 is slaved to the outer gimbal 13 to maintain the window 54 in front of the telescope beam expander 16.

A processor 60 is coupled to the photodetector 11, and to the respective reference beam source 21, 31, 41 and alignment mirrors 28, 57 and IMU 17. The processor 60 comprises software (illustrated in FIGS. 2–4) that implements closed loop feedback control of the alignment mirrors 28, 57 based upon the output of the photodetector 11 to adjust the alignment of the beams of the respective reference sources 21, 31, 41 to align the optical paths of the IR sensor receiver 22, the visible CCD sensor receiver 32 and the laser 43.

Figure 2:
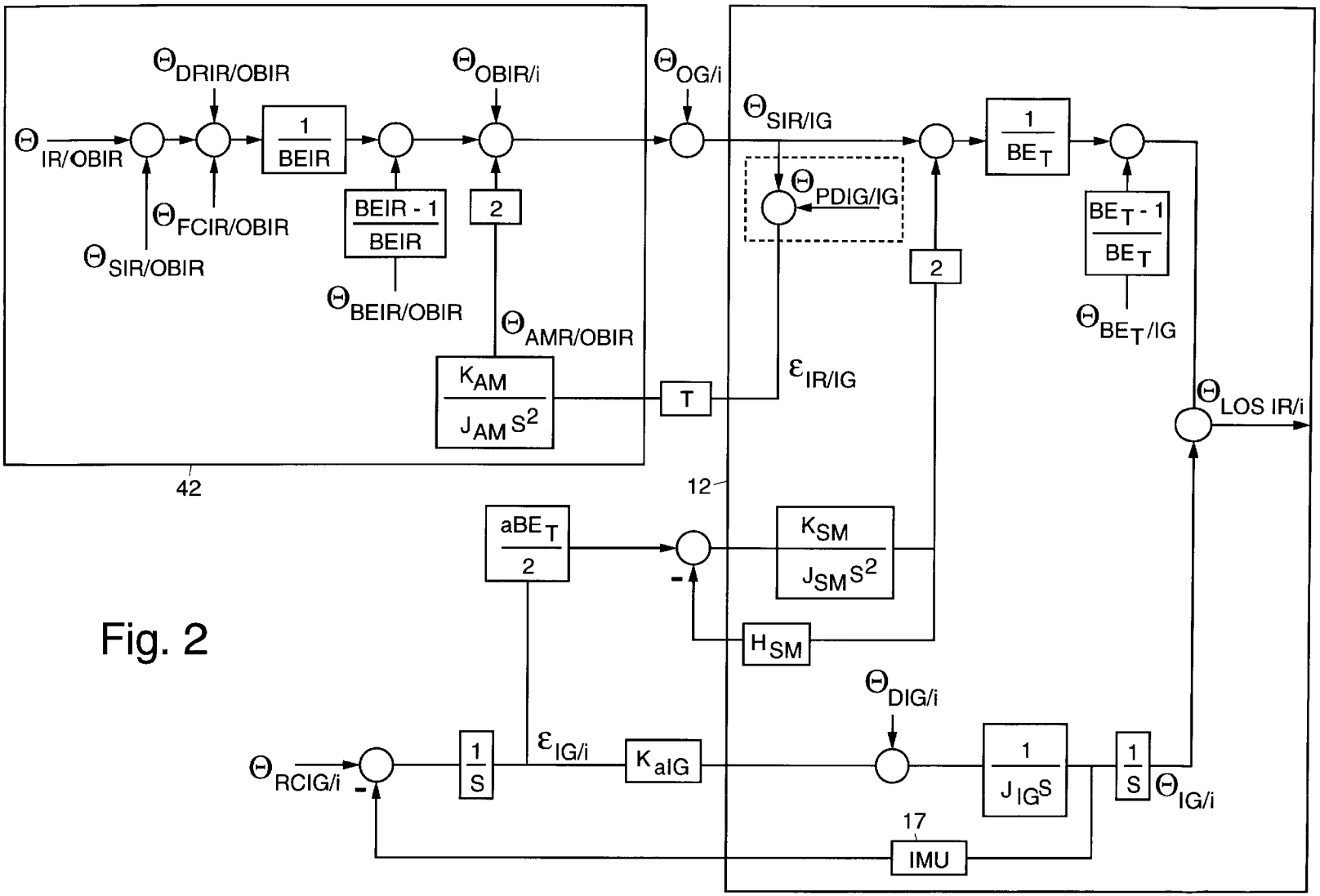
FIG. 2 is an optical servo block diagram for IR sensor line-of-sight stabilization employed in the system of FIG. 1.

The alignment of the IR sensor receiver 22 onto the inner gimbal 12 will now be discussed. An optical servo block diagram of the system 10 illustrated in FIG. 1 is shown in FIG. 2 and illustrates alignment and stabilization of the IR sensor receiver 22 in accordance with the principles of the present invention.

Figure 3:
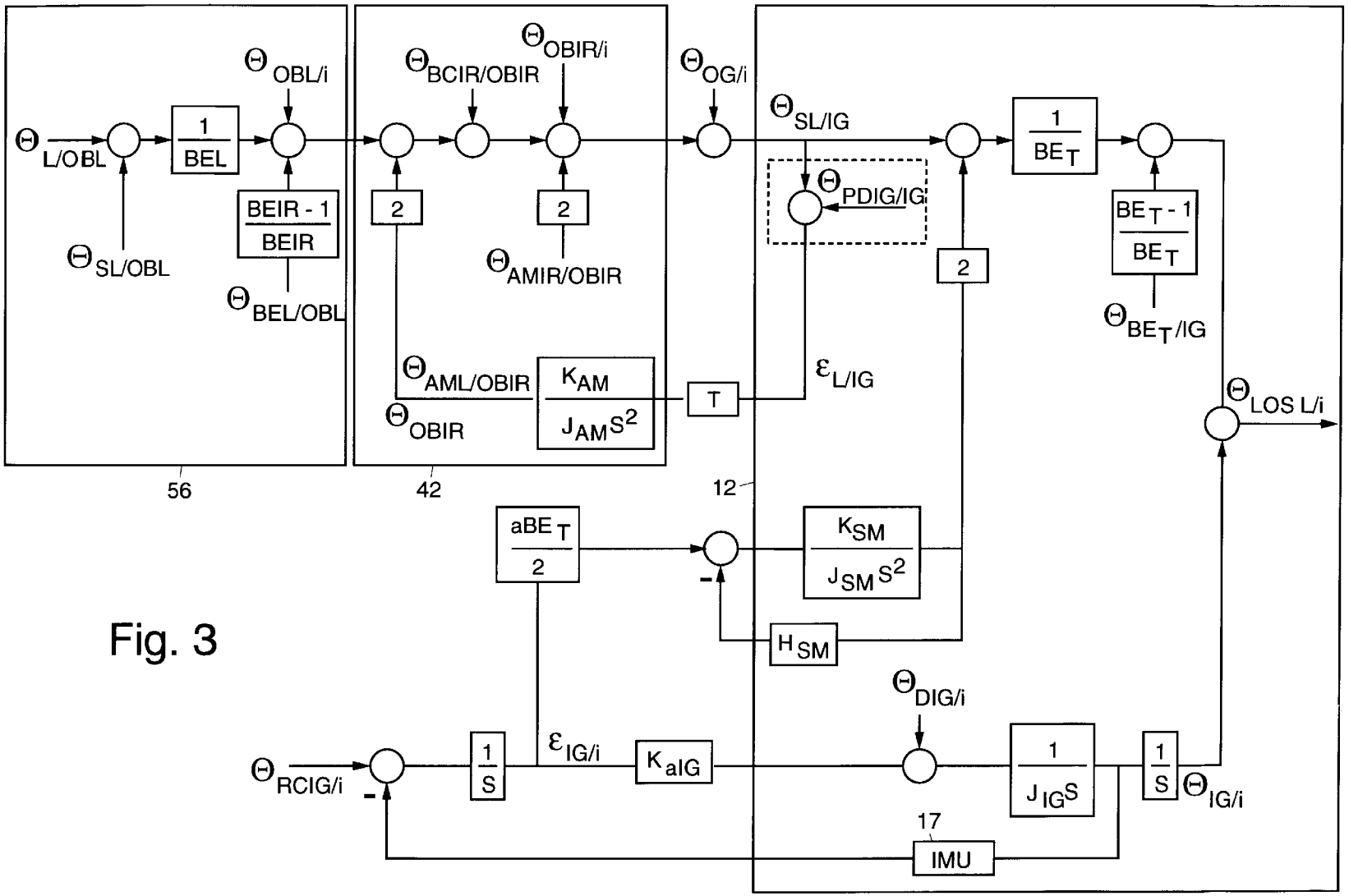
FIG. 3 is an optical servo block diagram for laser line-of-sight stabilization employed in the system of FIG. 1.
Figure 4:
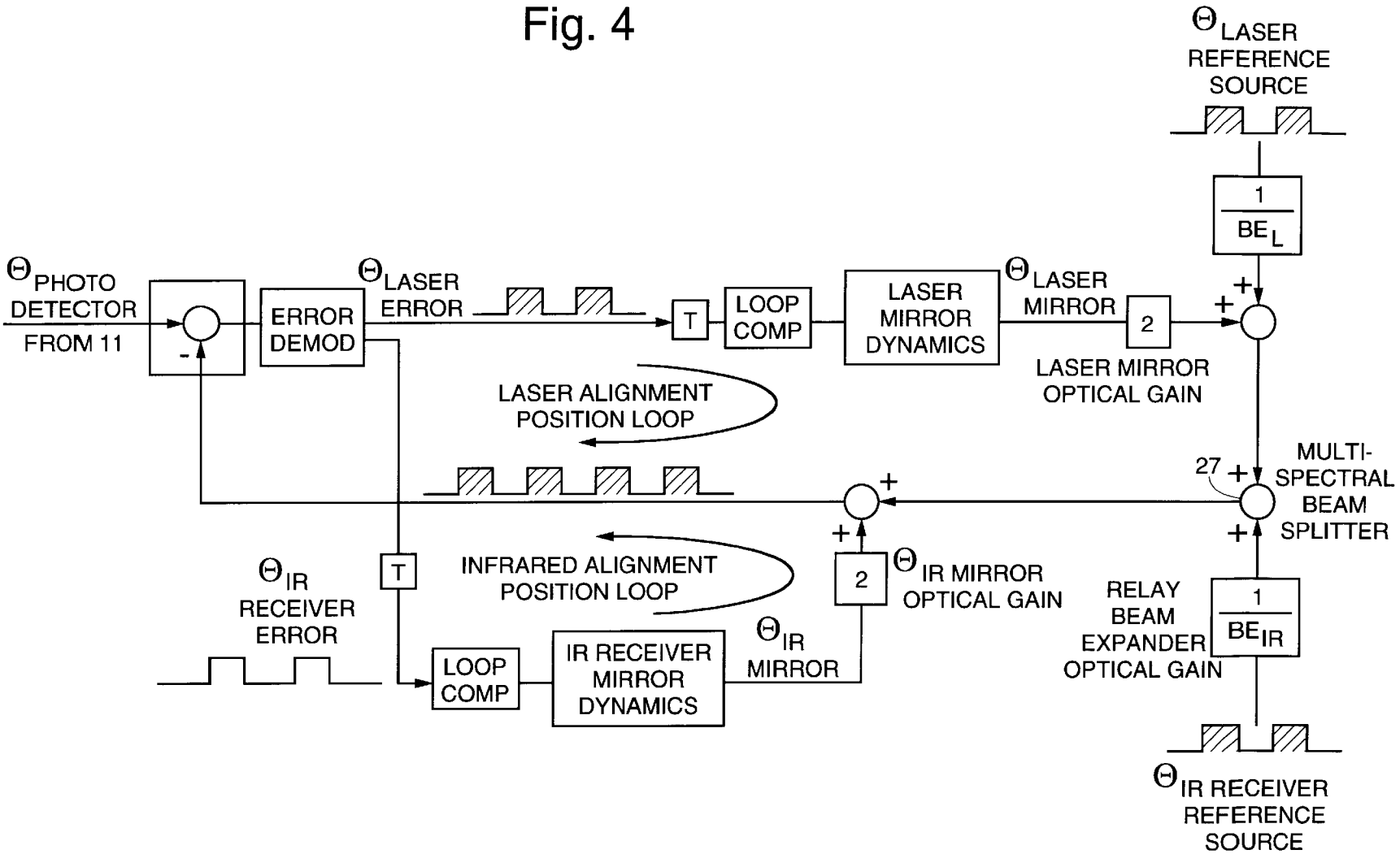
FIG. 4 illustrates a servo block diagram showing auto-alignment and time-multiplexed reference source modulation used in the system of FIG. 1.

The definition of terms relating to alignment and stabilization of the optical bench 42 are as follows. The following terms and others that are discussed below are shown in FIGS. 2–4.

$J_{AM}$ is the inertia of the alignment mirror 28. $K_{AM}$ is the position loop gain of the alignment mirror 28. $BE_{IR}$ is the optical magnification of the IR relay beam expander 26.

$\Theta_{IR/OBIR}$ is the angle of the IR receiver 22 relative to the IR/CCD optical bench 42. $\Theta_{SIR/OBIR}$ is the angle of the IR reference source 21 relative to the IR/CCD optical bench 42. $\Theta_{F/OBIR}$ $-\theta_{SF/OBIR}$ is the angle between the IR receiver 22 and the reference source 21, and is indicative of the mechanical alignment error.

$\Theta_{DRIR/OBIR}$ is the angle of induced errors of the derotation mechanism 25 relative to the IR/CCD optical bench 42. $\Theta_{FCIR/CBIR}$ is the angle of induced errors of the focus mechanism 24 relative to the IR/CCD optical bench 42. $\Theta_{BEIR/OBIR}$ is the angle of the IR relay beam expander 26 relative to the IR/CCD optical bench 42. $\Theta_{OBIR/i}$ is the angle of the IR/CCD optical bench 42 in inertial space.

$\Theta_{AMIR/OBIR}$ is the angle of the alignment mirror 28 relative to the IR/CCD optical bench 42. The alignment mirror 28 has an optical gain of 2 relative to its angular motion of the incident beams. The motion of this alignment mirror 28 aligns the IR or visible reference beams, and therefore the coaligned IR beam, to a detector null on the inner gimbal 12.

The sum of all of these angles is the angle of the IR beam and IR reference beam exiting off the IR/CCD optical bench 42 in inertial space.

The definition of terms with respect to the IR/CCD optical bench 42 and the inner gimbal 12 are as follows. $\Theta_{OG/i}$ is the angle of any elements on the outer gimbal 13 in inertial space that affect the beams. $\Theta_{IGi}$ is the angle of the inner gimbal 12 in inertial space. $\Theta_{SIR/IG}$ is the total angle of the steered IR and reference beams relative to the inner gimbal 12, and is the pseudo on-gimbal IR reference angle.

$\Theta_{PDIG/IG}$ is the angle of the photodetector 11 relative to the inner gimbal 12 which is mechanically aligned to the line of sight of the telescope 16. $\epsilon_{IR/IG}$ is the null angle error between the photodetector 11 and the pseudo gimbal IR reference angle i.e., $\epsilon_{IR/IG}$ $(\theta_{PDIG/IG}-\theta_{SIR/IG})$. The null is driven to zero by closing the beam nulling optical servo alignment loop. T is a coordinate transform that transforms photodetector errors into proper alignment mirror axis coordinates.

For simplification, let the sum of all optical path disturbance angles up to the inner gimbal photodetector 11 from the IR reference source $(\Theta_{SIR/OBIR})$ be defined by $\Theta_{SUM/ODIS}$, where $$\Theta_{SUM/ODIS}=(1/BE_{IR})[\Theta_{DRIR/OBIR}+\Theta_{FCIR/OBIR}+(BE_{IR}-1)\Theta_{DEIR/OBIR}]\Theta_{OEIR/i}+\Theta_{OG/i}$$

then the pseudo on-gimbal IR reference angle $(\Theta_{SIR/IG})$ is given by $$(\Theta_{SIR/IG}=\Theta_{SUM/ODIS}+2\Theta_{AMIR/OBIR}+(1/BE_{IR})\Theta_{SIR/OBIR}.$$

The photodetector angle aligned to the line of sight defined as zero $(\Theta_{PDIG/IG}=0)$ and the photodetector null $(\epsilon_{IR/IG})$ is driven to zero $(\epsilon_{IR/IG}=\Theta_{PDIG/IG}-\Theta_{SIR/IG}=0)$ by the closed loop action steering the alignment mirror, then the pseudo on-gimbal IR reference angle is zero $(\Theta_{SIR/IG}=0)$ and the IR reference and, therefore, the IR receiver beam is continuously and dynamically aligned to the inner gimbal even if all the defined inertial and gimbal angles vary for whatever cause.

The processor 60 measures the photodetector alignment output null error $(\epsilon_{IR/IG})$ in two axes, and applies a coordinate transform (T) to put the photodetector axes errors in the proper alignment mirror axis coordinates. The transform is a function of mirror axes orientation relative to photodetector axes which rotate with the rotation of both the inner and outer gimbal angles. The processor 60 then applies gain and phase compensation $(K_{AM})$ to the transformed errors to stabilize the closed servo loop. The processor 60 then drives the alignment mirror inertial $(J_{AM})$ via a torque amplifier until the mirror position $(\Theta_{AMIR/OBIR})$ is such that the photodetector error $(\epsilon_{IR/IG})$ is zero. In addition, the processor 60 controls the amplitude of the reference source beams to maintain constant power incident on the photodetector 11 and the time multiplexing of the beams of the multiple reference source 21, 31, 41.

With the detector angle aligned to the line of sight defined as zero $(\Theta_{PDIG/IG}=0)$ and the null is driven to zero $(\Theta_{PDIG/IG}-\Theta_{SIR/IG}=0)$. then the pseudo on-gimbal IR reference angle is zero $(\Theta_{SIR/IG}=0)$, and the IR reference beam, and therefore the beam associated with the IR sensor receiver 22 is continuously and dynamically aligned to the inner gimbal 12 even if all the defined inertial and gimbal angles vary for whatever reason.

The alignment operation for the visible CCD receiver 32 is similar to that of the IR sensor receiver 22. Since one receiver 22, 32 images at a time, i.e., only one optical reference source 21, 31 is excited at any one time, and the alignment mirror 28 services both the IR and visible channels. If both receivers 22, 32 are required to image simultaneously, another alignment mirror is required to be placed into the optical path of one or the other receivers 22, 32.

Line-of-sight stabilization will now be discussed. An optical servo block diagram showing line-of-sight stabilization of the IR receiver 32 in accordance with the principles of the present invention is shown in FIG. 2 and the line-of-sight stabilization of the laser 43 is shown in FIG. 3.

The definition of inertial rate stabilization loop terms relating to stabilizing the line of sight are as follows. $\Theta_{RCIG/ii}$ is a line-of-sight inertial rate loop command. IMU is the transfer function of the inertial rate measurement unit 17. $K_{aIG}$ is the rate stabilization loop gain transfer function of the inner gimbal 12. $J_{IG}$ is the inertia of the inner gimbal 12. $\Theta_{DIG/i}$ is the torque disturbance of the inner gimbal 12. $\Theta_{IG/i}$ is the inertial position of the inner gimbal 12. $\epsilon_{IG/i}$ is the residual inertial position error of the inertial rate stabilization loop.

Closure of the line-of-sight inertial rate stabilization loop with the low noise, high bandwidth inertial management unit 17 attenuates the input torque disturbances ($\Theta_{DIG/i}$). The magnitude of the residual inertial position error ($\epsilon_{IG/i}$) is the measure of its effectiveness in inertially stabilizing the line of sight, and is the input to the fine stabilization mirror loops.

The processor 60 closes the inertial rate loop to stabilize the line of sight. The IMU 17 measures the inertial rate of the inner gimbal 12 on which it is mounted. The inertial rate output measurement of the IMU 17 is compared to the commanded rate ($\Theta_{RCIG/i}$). The resulting rate error is integrated to provide the residual inertial position error ($\epsilon_{IG/i}$). The processor 60 then applies gain and phase compensation ($K_{aIG}$) to the errors to stabilize the closed servo loop. The processor 60 then drives the inner and outer gimbal inertia ($J_{IG}$) via a torquer amplifier until the gimbal inertial rates are such that the rate errors are zero.

The definition of terms for the fine stabilization mirror stabilization loops (FIG. 4) are as follows. $BE_T$ is the optical magnification of the common telescope beam expander 16. $H_{SM}$ is the position feedback scale factor of the stabilization mirror 15. $K_{SM}$ is the position loop gain of the stabilization mirror 15. $BE_T/2$ is electronic gain and phase matching term applied to the input of the stabilization mirror 15. $\Theta_{SM/IG}$ is the position of the stabilization mirror 15 relative to the inner gimbal 12.

The processor 60 closes the fine stabilization mirror position loops to finely stabilize the line of sight. The mirror position is measured by the position sensor ($H_{SM}$). The mirror position is compared to the commanded position ($aBE_T\epsilon_{IG/i}$). The resulting position error is gain and phase compensated ($K_{AM}$) to stabilize the closed servo loop. The processor 60 then drives the mirror inertia ($J_{AM}$) via a torquer amplifier until the mirror position ($\Theta_{SM/IG}$) is such that the position error is zero.

The stabilization mirror 15 has an optical gain of 2 relative to its angular motion on the incident beams. The motion of the stabilization mirror 15 steers the IR, visible, and laser beams, which are aligned at an angle ($\Theta_{SIR/MG}$) relative to the inner gimbal 12, as a function of the residual inertial position error ($\epsilon_{IG/}$). The beam, steered relative to the inner gimbal 12, and the inertial position of the inner gimbal 12 combine to result in a highly stabilized inertial line of sight ($\Theta_{LOS/i}$).

When an electronic gain ($aBE_T/2$) applied to the residual inertial position error (EIG/i) is adjusted in magnitude and phase, such that the term "a" closely matches the inverse of the closed stabilization mirror loop transfer function ($G_{SM}$) and the inertial management unit transfer function ($a \sim 1/G_{SM}IMU$), the resulting inertial line-of-sight angle error ($\Theta_{LOS/i}$) approaches zero.

$$\Theta_{LOS/I}=(\Theta_{SIR/IG}+2[H_{SM}][aBE_T/2][\epsilon_{IG/i}])+\Theta_{IG/I}=(\Theta_{SIR/IG}+2[H_{SM}][aBE_T/2][-IMU\Theta_{IG}])+\Theta_{IG/I}=0$$

$$\Theta_{LOS/I}=(\Theta_{SIR/IG}+2[H_{SM}][(1/H_{SM}IMU)BE_T/2][-IMU\Theta_{IG}]+\Theta_{IG/I}=(\Theta_{SIR/IG}-\Theta_{IG})+\Theta_{IG/I}=0$$

for ($\Theta_{SIR/IG}=0$, $\epsilon_{IG/i}=-IMU\Theta_{IG/i}$and a $-1/H_{SM}IMU$.

Alignment of the laser 43 onto the inner gimbal 12 will now be discussed. The laser line-of-sight alignment and stabilization is similar to the alignment of the IR receiver 22 and CCD receiver 32, except that the laser reference source 41 is used to close the alignment loop by driving the laser alignment mirror 57. The optical servo block diagram of this is depicted in FIG. 3 for laser alignment and stabilization.

The definition of terms relating to laser alignment are as follows. $BE_L$ is the optical magnification of the laser beam expander 45. $J_{AM}$ is the inertia of the laser alignment mirror 57. $K_{AM}$ is the position loop gain of the laser alignment mirror 57.

$\Theta_{L/OBL}$ is the angle of the laser 43 relative to the laser optical bench 56. $\Theta_{SL/OBL}$ is the angle of the laser reference source 41 relative to the laser optical bench 56. $\Theta_{BEL/OBL}$ is the angle of the laser beam expander 45 relative to the laser optical bench 56. $\Theta_{L/OBL}-\Theta_{SL/OBL}$ is the angle between the laser 43 and the laser reference source 41, which is the mechanical alignment error.

$\Theta_{OBL/i}$ is the angle of the laser optical bench 56 in inertial space. $\Theta_{AML/OBIR}$ is the angle of the laser alignment mirror 57 relative to the IR/CCD optical bench 42. The laser alignment mirror 57 has an optical gain of 2 relative to its angular motion on the incident laser and reference beams. The motion of the laser alignment mirror 57 aligns the laser reference beam, and therefore the coaligned laser beam, to a detector null on the inner gimbal 12.

$\Theta_{BCIR/OBIR}$ is the angle of the beam combiner 33 on the IR/CCD optical bench 42. $\Theta_{OBIR/i}$ is the angle of the IR/CCD optical bench 42 in inertial space. $\Theta_{AMIR/OBIR}$ is the angle of the alignment mirror 28 relative to the IR/CCD optical bench 42.

The sum of all of these angles is the angle of the laser beam and laser reference beam exiting off the IR/CCD optical bench 42 in inertial space.

The definition of terms relating to alignment from the IR/CCD optical bench 42 to the inner gimbal 12 are as follows. $\Theta_{OG/i}$ is the angle of any elements on the outer gimbal 13 in inertial space affecting the beams. $\Theta_{IG/i}$ is the angle of the inner gimbal 12 in inertial space. $\Theta_{SL/IG}$ is the total angle of the steered laser and reference beams relative to the inner gimbal 12, and is the pseudo on gimbal laser reference angle.

$\Theta_{PDIG/IG}$ is the angle of the photodetector 11 relative to the inner gimbal 12 that is mechanically aligned to the line of sight of the telescope 16. $\epsilon_{L/IG}$ is the null angle error between the photodetector 11 and the pseudo on-gimbal laser reference angle ($\Theta_{PDIG/IG}-\Theta_{SL/IG}$). The null is driven to zero by closing the beam nulling optical servo laser alignment loop. T is a coordinate transform to put the photodetector errors into proper alignment mirror axis coordinates.

With the detector angle defined as zero ($\Theta_{PDIG/IG}=0$) and the null is driven to zero ($\Theta_{PDIG/IG}-\Theta_{SL/IG}=0$), the pseudo on-gimbal laser reference angle is zero ($\Theta_{SL/IG}=0$), and the laser reference source 41, and therefore the laser beam, is continuously and dynamically aligned to the inner gimbal 12 even if all the defined inertial and gimbal angles vary for whatever reason.

The stabilization of the line of sight of the laser 43 is equivalent to stabilizing the IR and visible receivers 22, 32, since all the beams are aligned to the same on-gimbal photodetector 11, and they all share the same optical path in the forward direction, i.e., towards the fine stabilization mirror 15 and telescope 16.

The laser auto-alignment is similar to IR receiver auto-alignment, and for simplification, let the sum of all optical path disturbance angles up to the inner gimbal photodetector 11 from the laser reference source ($\Theta_{SL/OBL}$) be defined by $\Theta_{SUM/ODIS}$, where $$\Theta_{SUM/DISL}=(1/BE_L)[\Theta_{L/OBL}+(BE_L-1)\Theta_{BEL/OBL}]\Theta_{BCIR/OBIR}+\Theta_{OBIR/i}+2\Theta_{AMIR/OBIR}+\Theta_{OG/i}$$

then the pseudo on-gimbal IR reference angle ($\Theta_{SL/IG}$) is given by:

$$(\Theta_{SL/IG}=\Theta_{SUM/ODISL}+2\Theta_{AMIL/OBIR}+(1BE_L)\Theta_{SL/OBL}.$$

The photodetector angle aligned to the line of sight defined as zero ($\Theta_{PDIG/IG}=0$) and the photodetector null ($\epsilon_{L/IG}$) is driven to zero ($\epsilon_{L/IG}=\Theta_{PDIG/IG}-\Theta_{SL/IG}=0$) by the closed loop action steering the alignment mirror, then the pseudo on-gimbal laser reference angle is zero ($\Theta_{SL/IG}=0$) and the laser reference and, therefore, the laser beam is continuously and dynamically aligned to the inner gimbal 12 even if all the defined inertial and gimbal angles vary for whatever cause.

The processor 60 measures the photodetector alignment output null error ($\epsilon_{L/IG}$) in two axes, and applies a coordinate transform (T) to put the photodetector axes errors in the proper alignment mirror axis coordinates. The transform is a function of mirror axes orientation relative to photodetector axes which rotate with the rotation of both the inner and outer gimbal angles. The processor 60 then applies gain and phase compensation ($K_{AM}$) to the transformed errors to stabilize the closed servo loop. The processor 60 then drives the alignment mirror inertial ($J_{AM}$) via a torquer amplifier until the mirror position ($\Theta_{AML/OBIR}$) is such that the photodetector error ($\epsilon_{L/IG}$) is zero.

A reverse auto-alignment configuration may also be implemented with the photodetector 11 replacing the optical reference sources 21, 31, 41 and an optical reference source 21 replacing the photodetector 11, i.e., a single optical source 21 aligned to the line of sight of the telescope 16 on-gimbal, and two photodetectors 1 each aligned to the receivers 22, 32 and laser off-gimbal. Each configuration has its relative pros and cons. Which configuration is implemented depends of selection criteria important to a system designer, such as performance, cost, reliability, producibility, power, weight, and volume, etc.

Tests were performed to verify the performance of the present invention. A brassboard containing Advanced Targeting FLIR optics, optical bench 42, and IR receiver 22, which included a laser 43 and an analog version of the auto-alignment system 10, was functionally qualitatively and quantitatively tested. A disturbance mirror was added to the laser optical path to simulated dynamic angular disturbances to demonstrate the ability of the auto-alignment system 10 to correct for both initial static IR sensor (IR receiver 22) and laser 43 line-of-sight misalignment as well as provide continuous dynamic correction of the line of sight. A servo block diagram illustrating the auto-alignment system 10 and time multiplexed reference source modulation is shown in FIG. 4.

Thus, a system for providing line-of-sight alignment and stabilization of off-gimbal electro-optical passive and active sensors has been disclosed. It is to be understood that the above-described embodiment is merely illustrative of some of the many specific embodiments that represent applications of the principles of the present invention. Clearly, numerous and other arrangements can be readily devised by those skilled in the art without departing from the scope of the invention.

What is claimed is:

1. Optical apparatus for use in auto-aligning line-of-sight optical paths of at least one sensor and a laser, comprising:

at least one reference source for outputting at least one reference beam that is optically aligned with the line-of-sight of the at least one sensor;

a laser reference source for outputting a laser reference beam that is optically aligned with the line-of-sight of the laser;

a laser alignment mirror for adjusting the alignment of the line of sight of the laser beam;

a sensor alignment mirror for adjusting the alignment of the at least one sensor;

combining optics for coupling the plurality of reference beams along a common optical path;

gimbal apparatus;

a detector disposed on the gimbal apparatus for detecting the plurality of reference beams;

a fine stabilization mirror disposed on the gimbal apparatus for adjusting the line of sight of the optical paths of the at least one sensor and the laser; and a processor coupled to the detector, the laser alignment mirror, the sensor alignment mirror, and the fine stabilization mirror for processing signals detected by the detector and outputting control signals to the respective mirrors to align the line-of-sight optical paths of the sensor and the laser.

2. The apparatus recited in claim 1 wherein the at least one sensor comprises an infrared sensor, and the at least one reference source comprises an infrared reference source.

3. The apparatus recited in claim 1 wherein the at least one sensor comprises an visible sensor, and the at least one reference source comprises an visible reference source.

4. The apparatus recited in claim 2 wherein the at least one sensor further comprises an visible sensor, and the at least one reference source further comprises an visible reference source.

5. The apparatus 10 in claim 1 wherein the infrared reference source, the visible reference source and the laser reference source 41 comprise time-multiplexed modulated reference sources.

6. The apparatus recited in claim 1 wherein the detector comprises a photodetector.

7. Optical apparatus for use in auto-aligning line-of-sight optical paths of an infrared sensor, a visible sensor, and a laser, comprising:

an infrared reference source for outputting an infrared reference beam that is optically aligned with the line-of-sight of the infrared sensor;

a visible reference source for outputting a visible reference beam that is optically aligned with the line-of-sight of the visible sensor;

a laser reference source for outputting a laser reference beam that is optically aligned with the line-of-sight of the laser;

a laser alignment mirror for adjusting the alignment of the laser beam;

an IR/CCD alignment mirror for adjusting the alignment of the line of sight of the infrared and visible sensors;

combining optics for coupling the plurality of reference beams along a common optical path;

gimbal apparatus;

a detector disposed on the gimbal apparatus for detecting the plurality of reference beams;

a fine stabilization mirror disposed on the gimbal apparatus for adjusting the line of sight of the optical paths of the infrared sensor, the visible sensor, and the laser; and a processor coupled to the detector, the laser alignment mirror, the IR/CCD alignment mirror, and the fine stabilization mirror for processing signals detected by the detector and outputting control signals to the respective mirrors to align the line-of-sight optical paths of the infrared sensor, the visible sensor, and the laser.

8. The apparatus recited in claim 7 wherein the infrared reference source, the visible reference source and the laser reference source comprise time-multiplexed modulated reference sources.

9. The apparatus recited in claim 7 wherein the detector comprises a photodetector.

* * * * *